US008939603B2

(12) United States Patent
Huang et al.

(10) Patent No.: US 8,939,603 B2
(45) Date of Patent: Jan. 27, 2015

(54) LED LAMP TUBE

(75) Inventors: Huan-Hsiang Huang, New Taipei (TW); Chan-Hung Shao, New Taipei (TW)

(73) Assignee: Chicony Power Technology Co., Ltd., New Taipei (TW)

( * ) Notice: Subject to any disclaimer, the term of this patent is extended or adjusted under 35 U.S.C. 154(b) by 324 days.

(21) Appl. No.: 13/482,153

(22) Filed: May 29, 2012

(65) Prior Publication Data

US 2013/0208458 A1 Aug. 15, 2013

(30) Foreign Application Priority Data

Feb. 15, 2012 (TW) ..... 101202730 A

(51) Int. Cl.
*F21V 19/00* (2006.01)
*F21V 19/04* (2006.01)

(52) U.S. Cl.
CPC ..... *F21V 19/009* (2013.01); *F21V 19/045* (2013.01)
USPC ..... 362/218; 362/249.02

(58) Field of Classification Search
CPC ..... F21V 15/011; F21V 17/12; F21V 19/009; F21V 19/045
See application file for complete search history.

(56) References Cited

U.S. PATENT DOCUMENTS 1,667,380 A * 4/1928 Handlan ..... 362/428
7,594,738 B1 * 9/2009 Lin et al. ..... 362/249.02
7,976,196 B2 * 7/2011 Ivey et al. ..... 362/294
8,047,674 B2 * 11/2011 Liu ..... 362/218

* cited by examiner

*Primary Examiner* — Sharon Payne
(74) *Attorney, Agent, or Firm* — Chun-Ming Shih; HDLS IPR Services

(57) ABSTRACT

A LED lamp tube includes a hollow transparent tube body, a heat-dissipating base disposed in the tube body, a light-emitting module, a control circuit module, an electrical-conductive element, and electrical-conductive caps covering the tube body. The light-emitting module and the control circuit module are provided on two opposite surfaces of the heat-dissipating base respectively. The electrical-conductive element penetrates the heat-dissipating base to be electrically connected to the light-emitting module and the control circuit module. By this structure, the LED lamp tube can be assembled more easily with reduced soldering steps.

9 Claims, 6 Drawing Sheets

LED LAMP TUBE

BACKGROUND OF THE INVENTION

1. Field of the Invention

The present invention relates to a lamp, and in particular to a LED lamp tube.

2. Description of Prior Art

With the advance of science and technology, various light-emitting diodes (LEDs) are developed. The lamp tube having LEDs has been widely used to replace traditional fluorescent lamp tube because the LED lamp tube has low electricity consumption and a long lifetime. The conventional LED lamp tube includes a tube body, a heat-dissipating plate, a circuit board, a LED light-emitting element, and two electrical-conductive caps. The heat-dissipating plate is disposed in the tube body. The circuit board is adhered to the heat-dissipating plate. The light-emitting element is electrically connected to the circuit board.

In assembly, the LED light-emitting element is electrically soldered onto the circuit board. The LED light-emitting element and the circuit board are fixed to the heat-dissipating plate. Then, two leads are electrically soldered to the circuit board and the two electrical-conductive caps respectively. Finally, the two electrical-conductive caps cover both ends of the tube body respectively and are electrically connected to an external power source (such as an outlet of public power). By this arrangement, the electricity from the external power source can be transmitted to the LED light-emitting element via the two electrical-conductive caps, the leads and the circuit board, so that the LED light-emitting element can emit light for illumination. However, as mentioned above, the assembly of the conventional LED lamp tube involves more complicated steps and needs several soldering steps, which increases the time for assembly.

On the other hand, the circuit board and the LED light-emitting element are fixedly connected to each other by soldering. If one of the circuit board and the LED light-emitting element suffers damage or breakdown, the damaged circuit board or the LED light-emitting element cannot be replaced alone but the whole set of the LED lamp tube has to be abandoned. Thus, such a structure of the conventional LED lamp tube increases the maintenance cost and does not conform to the concept of environmental protection.

Therefore, the present Inventor aims to solve the above-mentioned problems.

SUMMARY OF THE INVENTION

The present invention is to provide a LED lamp tube, which can be assembled easily and the circuit board or the LED light-emitting element can be replaced alone.

The present invention provides a LED lamp tube, including:

a hollow transparent tube body;

a heat-dissipating base disposed in the transparent tube body and engaged with inner walls of the transparent tube body;

a light-emitting module provided on one surface of the heat-dissipating base;

a control circuit module provided on the other surface of the heat-dissipating base to be separated from the light-emitting module;

an electrical-conductive element penetrating the heat-dissipating base to be electrically connected to the light-emitting module and the control circuit module; and a pair of electrical-conductive caps covering both ends of the tube body to be electrically connected to the control circuit module.

In comparison with prior art, the present invention has the following advantageous features.

According to the present invention, the heat-dissipating base of the present invention is disposed in the tube body and engaged with the inner walls of the tube body. The light-emitting module and the control circuit module are provided on two opposite surfaces of the heat-dissipating base respectively. The electrical-conductive element penetrates the heat-dissipating base to be electrically connected to the light-emitting module and the control circuit module. Thus, the light-emitting module can be fixedly connected to the control circuit module without soldering steps. Further, the transparent tube body, the heat-dissipating base, the light-emitting module and the control circuit module are all assembled together without screws and soldering steps, which simplifies the assembly. If one of the above parts of the LED lamp tube of the present invention suffers damage or breakdown, the user can only replace the damaged part without abandoning the whole set of LED lamp tube. Therefore, such an inventive structure reduces the maintenance cost and conforms to the concept of environmental protection.

DETAILED DESCRIPTION OF THE INVENTION

Figure 1:
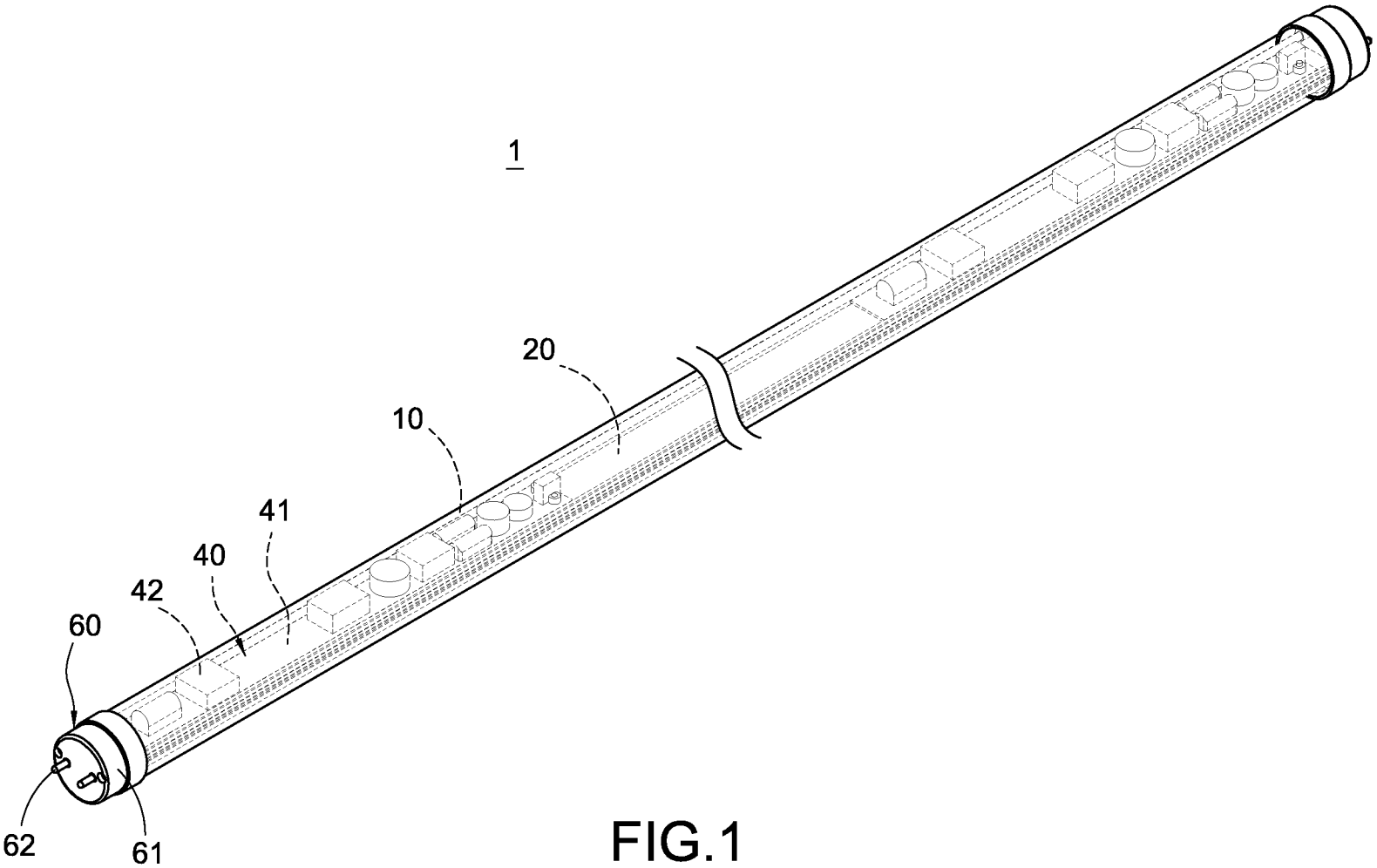
FIG. 1 is an assembled perspective view of the present invention.

The detailed description and technical contents of the present invention will become apparent with the following detailed description accompanied with related drawings. It is noteworthy to point out that the drawings is provided for the illustration purpose only, but not intended for limiting the scope of the present invention.

Please refer to FIGS. 1 to 4. The present invention provides a hollow transparent tube body 10, a heat-dissipating base 20, a light-emitting module 30, a control circuit module 40, a plurality of electrical-conductive elements 50, and a pair of electrical-conductive caps 60.

The transparent tube body 10 is made of transparent insulating materials, thereby preventing a user from getting an electric shock when touching the transparent tube body 10. In the present invention, the transparent tube body 10 is formed into an integral tubular body, thereby preventing the problem in prior art that the user may get an electric shock when touching a semi-circular tube body. The transparent tube body 10 has two open ends in communication with its interior. The interior of the transparent tube body 10 is configured to accommodate the heat-dissipating base 20, the light-emitting module 30, the control circuit module 40, and the electrical-conductive elements 50. It can be seen from FIG. 2 that, the inner walls of the transparent tube body 10 are formed with two opposite ribs 11.

Figure 3:
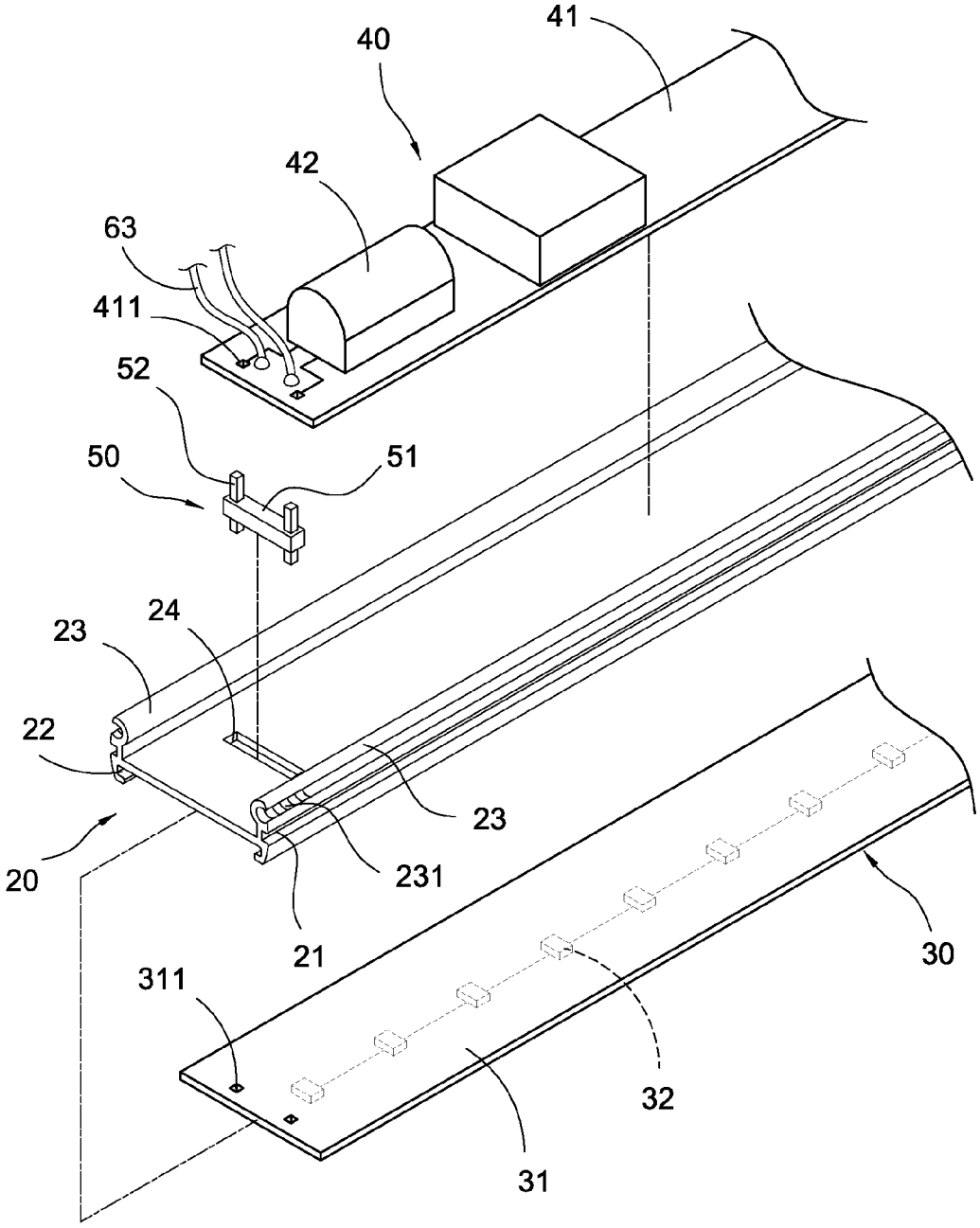
FIG. 3 is an exploded perspective view showing the heat-dissipating base, the LED light-emitting module and the control circuit module of the present invention.

Please refer to FIG. 3. The heat-dissipating base 20 is formed into an elongate rectangular shape and made of metallic materials having good heat conductivity. Two side edges of the heat-dissipating base 20 are provided with two grooves 21 for allowing the ribs 11 to be engaged therewith. By this structure, the heat-dissipating base 20 can be disposed into the transparent tube body 10 and engaged with the ribs 11 formed on the inner walls of the transparent tube body 10.

Further, as shown in FIG. 3, two side edges of the heat-dissipating base 20 are bent downwardly to form two lower folded edges 22 respectively. A space is formed between the two lower folded edges 22 for allowing the light-emitting module 30 to be disposed therein. Similarly, the two side edges of the heat-dissipating base 20 are bent upwardly to form two upper folded edges 23 respectively. A space is formed between the two upper folded edges 23 for accommodating the control circuit module 40.

The light-emitting module 30 is provided on one surface (i.e. the lower surface) of the heat-dissipating base 20. More specifically, the light-emitting module 30 is provided on the lower surface of the heat-dissipating base 20 and inserted between the two lower folded edges 22. In the present embodiment, the light-emitting module 30 comprises a circuit board 31 provided on the lower surface of the heat-dissipating base 20 and inserted between the lower folded edges 22 as well as a plurality of LEDs 32 electrically arranged on the circuit board 31. Of course, the light-emitting module 30 may be constituted of one elongate circuit board or a plurality of circuit boards connected in series, thereby forming a LED lamp strip.

The control circuit module 40 is provided on the other surface (i.e. the upper surface) of the heat-dissipating base 20 to be separated from the light-emitting module 30. The control circuit module 40 includes a circuit substrate 41 provided on the upper surface of the heat-dissipating base 20 and inserted between the two upper folded edges 23 as well as at least one transformer 42 electrically arranged on the circuit substrate 41. Of course, the circuit substrate 41 of the present invention can be constituted of one elongate circuit board or a plurality of circuit board connected in series. One end of the circuit substrate 41 is electrically soldered to two leads 63. The two leads 63 are electrically connected to an insertion terminal 62 of an electrical-conductive cap 60 respectively.

It should be noted that the light-emitting module 30 and the control circuit module 40 are separated from each other by the heat-dissipating base 20. Further, the control circuit module 40 is disposed in the transparent tube body 10. Thus, the control circuit module 40 will not affect the heat-dissipating effect of the heat-dissipating base 20 on the light-emitting module 30.

Figure 4:
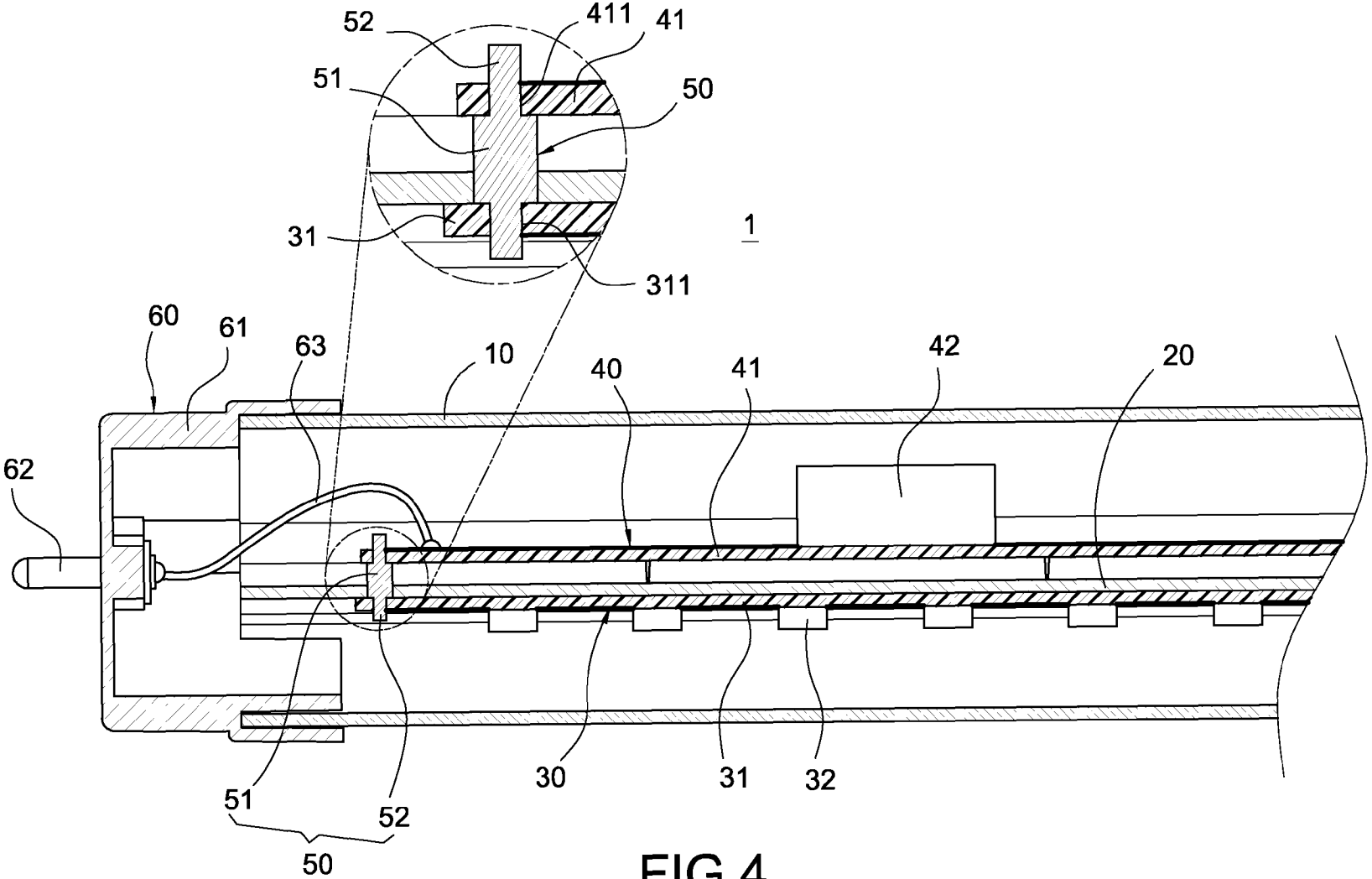
FIG. 4 is an assembled cross-sectional view of the present invention.

The electrical-conductive element 50 is configured to reduce the electrical soldering between the light-emitting module 30 and the control circuit module 40. The electrical-conductive element 50 penetrates the heat-dissipating base 20 to be electrically connected to the light-emitting module 30 and the control circuit module 40. More specifically, in the embodiment of FIG. 3, the electrical-conductive element 50 has a main portion 51 and two electrical-conductive portions 52 vertically formed on both ends of the main portion 51. The main portion 51 is made of insulating materials. The two electrical-conductive portions 52 are made of metallic materials having electrical conductivity. One end of the circuit board 31 of the light-emitting module 30 is provided with two through-holes 311. One end of the circuit substrate 41 of the control circuit module 40 is provided with two via holes 411 corresponding to the two through-holes 311 respectively. The heat-dissipating base 20 is provided with a trough 24 at a position corresponding to the two through-holes 311 and the two via holes 411. By this structure, as shown in FIG. 4, the main portion 51 of the electrical-conductive element 50 can be disposed in the trough 24 of the heat-dissipating base 20. The electrical-conductive portions 52 are respectively inserted into the two through-holes 311 of the light-emitting module 30 and the two via holes 411 of the control circuit module 40. By means of the electrical-conductive elements 50, the light-emitting module 30, the heat-dissipating base 20, and the control circuit module 40 can be assembled and electrically connected together.

The pair of electrical-conductive caps 60 cover both ends of the transparent tube body 10 to be electrically connected to the control circuit module 40. More specifically, as shown in FIG. 4, each electrical-conductive cap 60 has a cap body 61, two insertion terminals 62 penetrating the cap body 60, and two leads 63 electrically connected to the two insertion terminals 62. The other ends of the two leads 63 are electrically soldered to one end of the control circuit module 40.

Figure 2:
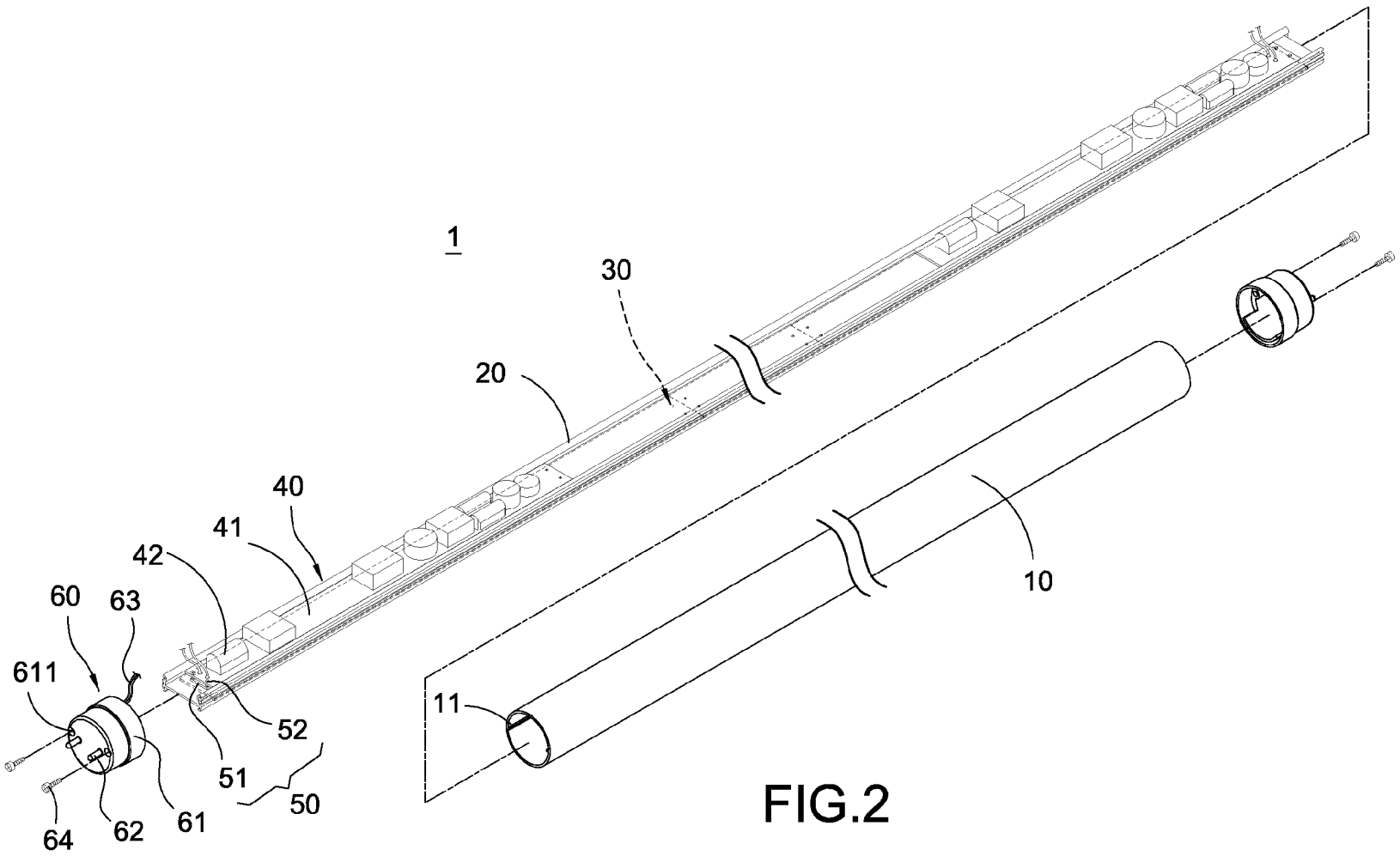
FIG. 2 is an exploded perspective view of the present invention.

It can be seen from FIG. 2 that, the cap body 61 of the electrical-conductive cap 60 is provided with two penetration holes 611. Two screws 64 are inserted into the two penetration holes 611 to be fastened into the two upper folded edges 23 of the heat-dissipating base 20. In order to increase the fastening strength of the screws 64, the inner wall of the upper folded edge 23 can be formed with outer threads 231 in advance.

According to the above structure, only one end of the lead 63 away from the insertion terminal 62 needs to be electrically soldered to the circuit substrate 41 of the control circuit module 40. The other parts of the present invention are detachably assembled together. Thus, the present invention reduces the soldering steps and increases the convenience in assembly. Further, the structure of the present invention facilitates the replacement of damaged parts without abandoning the whole set of LED lamp tube, so that the maintenance cost and the number of the waste components can be reduced. Therefore, the present invention conforms to the concept of environmental protection.

Figure 5:
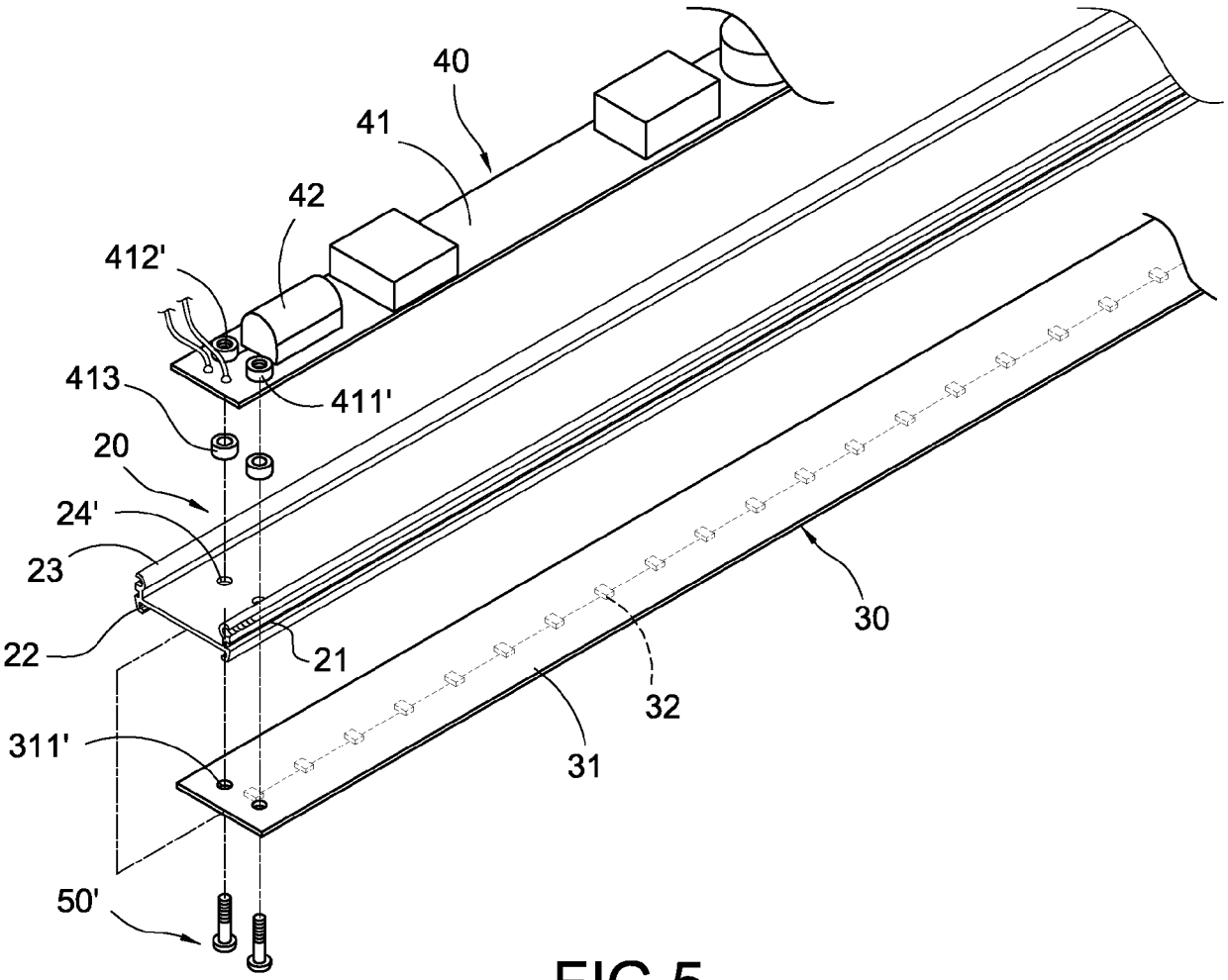
FIG. 5 is an exploded perspective view showing another embodiment of the present invention.
Figure 6:
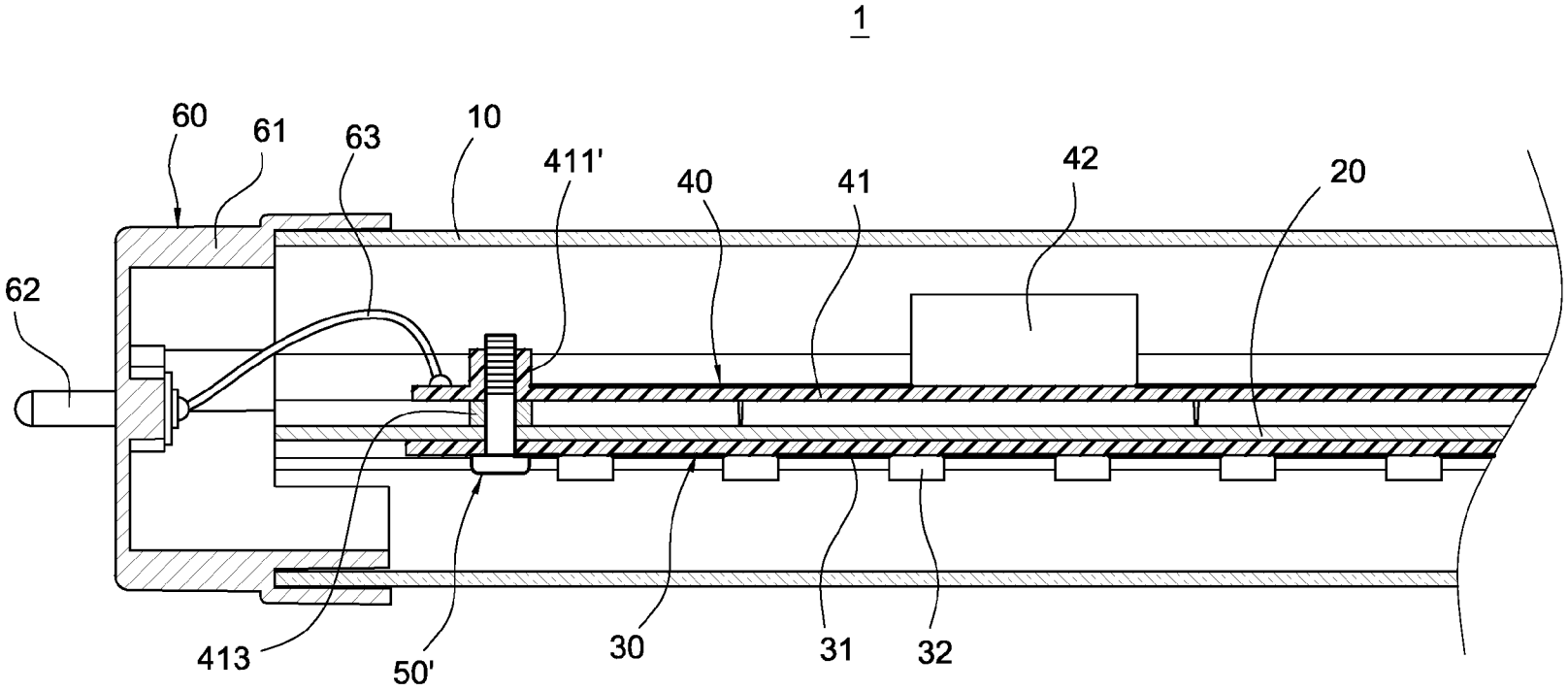
FIG. 6 is an assembled cross-sectional view showing another embodiment of the present invention.

Please refer to FIGS. 5 and 6, which show another embodiment of the present invention. The difference between the present embodiment and the previous embodiment lies in that: the electrical-conductive elements are two electrical-conductive bolts 50' rather than electrical-conductive terminals. More specifically, the circuit board 31 of the light-emitting module 30 is provided with two through-holes 311'. The heat-dissipating base 20 is provided with two penetration holes 24' corresponding to the two through-holes 311'. The circuit substrate 41 of the control circuit module 40 is fixedly provided with two posts 411'. Each post 411' is provided therein with an inner threaded hole 412' corresponding to the penetration hole 24'. The electrical-conductive bolt 50' sequentially penetrates the through-hole 311' of the circuit board 31, the penetration hole 24' of the heat-dissipating base 20, and the post 411' of the circuit substrate 41 to be fastened into the inner threaded hole 412'. By means of the electrical-conductive bolt 50', the light-emitting module 30, the heat-dissipating base 20, and the control circuit module 40 can be assembled and electrically connected together. Further, the electrical-conductive bolt 50' may penetrate an insulation sleeve 413 between the heat-dissipating base 20 and the circuit substrate 41.

In comparison with prior art, the present invention has the following advantageous features.

According to the present invention, the heat-dissipating base 20 of the present invention is disposed in the transparent tube body 10 and engaged with the inner walls of the transparent tube body 10. The light-emitting module 30 and the control circuit module 40 are provided on two opposite surfaces of the heat-dissipating base 20 respectively. The electrical-conductive element 50 or the electrical-conductive bolt 50' penetrates the heat-dissipating base 20 to be electrically connected to the light-emitting module 30 and the control circuit module 40. Thus, the light-emitting module 30 can be fixedly connected to the control circuit module 40 without soldering steps. Further, the transparent tube body 10, the heat-dissipating base 20, the light-emitting module 30 and the control circuit module 40 are all assembled together without screws and soldering steps, which simplifies the assembly process. If one of the above parts of the LED lamp tube of the present invention suffers damage or breakdown, the user can only replace the damaged part without abandoning the whole set of the LED lamp tube. Therefore, such an inventive structure reduces the maintenance cost and conforms to the concept of environmental protection.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A light-emitting diode (LED) lamp tube, including:

a hollow transparent tube body;

a heat-dissipating base disposed in the transparent tube body and engaged with inner walls of the transparent tube body;

a light-emitting module provided on a first surface of the heat-dissipating base;

a control circuit module provided on a second surface of the heat-dissipating base to be separated from the light-emitting module;

an electrical-conductive element penetrating the heat-dissipating base to be electrically connected to the light-emitting module and the control circuit module; and a pair of electrical-conductive caps covering both ends of the tube body to be electrically connected to the control circuit module, wherein two opposite side edges of the heat-dissipating base are bent downwardly toward a first surface thereof to form first inwardly folded edges, a first track is formed on the first surface and defined by the two first inwardly folded edges, and a circuit board of the light-emitting module is guided by the two first inwardly folded edges to slidably fit on the first track;

wherein the two opposite side edges of the heat-dissipating base are bent upwardly toward a second surface thereof to form second inwardly folded edges, a second track is formed on the second surface and defined by the two second inwardly folded edges, and a circuit substrate of the control circuit module is guided by the two second inwardly folded edges to slidably fit on the second track.

2. The LED lamp tube according to claim 1, wherein the tube body is made of insulating materials.

3. The LED lamp tube according to claim 1, wherein the inner walls of the transparent tube body are formed with two opposite ribs, two opposite side edges of the heat-dissipating base are provided with two grooves respectively for allowing the two ribs to be engaged therewith.

4. The LED lamp tube according to claim 1, wherein the light-emitting module comprises the circuit board and a plurality of LEDs electrically arranged on the circuit board.

5. The LED lamp tube according to claim 1, wherein the control circuit module includes the circuit substrate and at least one transformer electrically arranged on the circuit substrate.

6. The LED lamp tube according to claim 1, wherein the electrical-conductive element has a main portion and two electrical-conductive portions formed on both ends of the main portion, the main portion is made of insulating materials, the two electrical-conductive portions are made of metallic materials, one end of the circuit board is provided with two through-holes, one end of the circuit substrate is provided with two via holes corresponding to the two through-holes, the heat-dissipating base is provided with a trough at a position corresponding to the two through-holes and the two via holes, the main portion is disposed in the trough, and the two electrical-conductive portions are inserted into the two through-holes and the two via holes respectively.

7. The LED lamp tube according to claim 1, wherein the electrical-conductive element is an electrical-conductive bolt made of metallic materials, the circuit board is provided with two through-holes, the heat-dissipating base is provided with two penetration holes corresponding to the two through-holes, the circuit substrate is fixedly provided with two posts, each post is provided with an inner threaded hole, and the electrical-conductive bolt penetrates the through-hole and the penetration hole to be fastened into the inner threaded hole.

8. The LED lamp tube according to claim 1, wherein each electrical-conductive cap has a cap body, two insertion terminals penetrating the cap body, and two leads electrically connected to the two insertion terminals, and the other ends of the two leads are electrically soldered to the circuit substrate of the control circuit module.

9. The LED lamp tube according to claim 8, wherein the cap body is provided with two penetration holes, and the two screws are inserted into the penetration holes to be fastened into the two upper folded edges to thereby fix the electrical-conductive caps to the heat-dissipating base.

* * * * *